United States Patent [19]

Gavilan

[11] Patent Number: 4,836,749

[45] Date of Patent: Jun. 6, 1989

[54] PRE-LOAD DEVICE FOR A TURBOMACHINE ROTOR

[75] Inventor: William A. Gavilan, Pfafftown, N.C.

[73] Assignee: Westinghouse Electric Corp., Pittsburgh, Pa.

[21] Appl. No.: 244,442

[22] Filed: Sep. 14, 1988

Related U.S. Application Data

[63] Continuation-in-part of Ser. No. 157,684, Feb. 19, 1988, abandoned.

[51] Int. Cl.[4] ..... F01D 5/32

[52] U.S. Cl. ..... 416/221; 416/241 R; 416/218; 416/222

[58] Field of Search ..... 416/221, 220 R, 241 R, 416/218, 222

[56] References Cited

U.S. PATENT DOCUMENTS

| | | | |
|---|---|---|---|
| 1,619,133 | 1/1922 | Kasley . | |
| 2,317,338 | 4/1943 | Rydmark . | |
| 2,595,829 | 5/1952 | Dean . | |
| 2,643,853 | 6/1953 | Redding . | |
| 2,753,149 | 3/1951 | Kurti . | |
| 2,801,074 | 10/1952 | Brown . | |
| 3,043,563 | 7/1962 | Gray et al. . | |
| 3,244,236 | 4/1966 | Langham . | |
| 3,572,970 | 3/1971 | Smuland | 416/221 |
| 3,910,719 | 10/1975 | Hessler et al. | 416/134 |
| 3,922,109 | 11/1975 | Hagen | 416/213 |
| 4,022,545 | 5/1977 | Shank | 416/221 |
| 4,037,990 | 7/1977 | Harris | 416/220 R |
| 4,051,585 | 10/1977 | Walker et al. | 416/241 B X |
| 4,417,854 | 11/1983 | Cain et al. | 416/241 B |
| 4,453,891 | 6/1984 | Forestier | 416/220 R |
| 4,613,388 | 9/1986 | Walter et al. | 148/425 |

FOREIGN PATENT DOCUMENTS

| | | | |
|---|---|---|---|
| 644571 | 7/1962 | Canada | 416/221 |
| 1204858 | 8/1959 | France | 416/221 |
| 2101635 | 1/1983 | United Kingdom . | |

*Primary Examiner*—Everette A. Powell, Jr.
*Attorney, Agent, or Firm*—K. Bach

[57] ABSTRACT

The pre-load device for a turbomachine rotor according to the invention has a shank formed of a superplastic material which is axially insertable in a shank bore formed between confronting notches formed on a rotor disk and a blade root portion. In one embodiment, the notches extend generally parallel to the longitudinal axis of rotation of the rotor disk. The shank defines an interior chamber in which is located a low-melting point material. An electrical resistance heating element is located in the low-melting point material and has means to be connected to an electrical source. The device also includes headed portions attached to each end of the shank, each of the headed portions bearing against axially facing surfaces of the rotor disk and the blade root so that, when the head means are attached, relative axial movement between the elements is prevented. In another embodiment, the notches extend generally transverse to the longitudinal axis of rotation in a projection on the rotor disk and a mounting groove in the blade root portion.

14 Claims, 4 Drawing Sheets

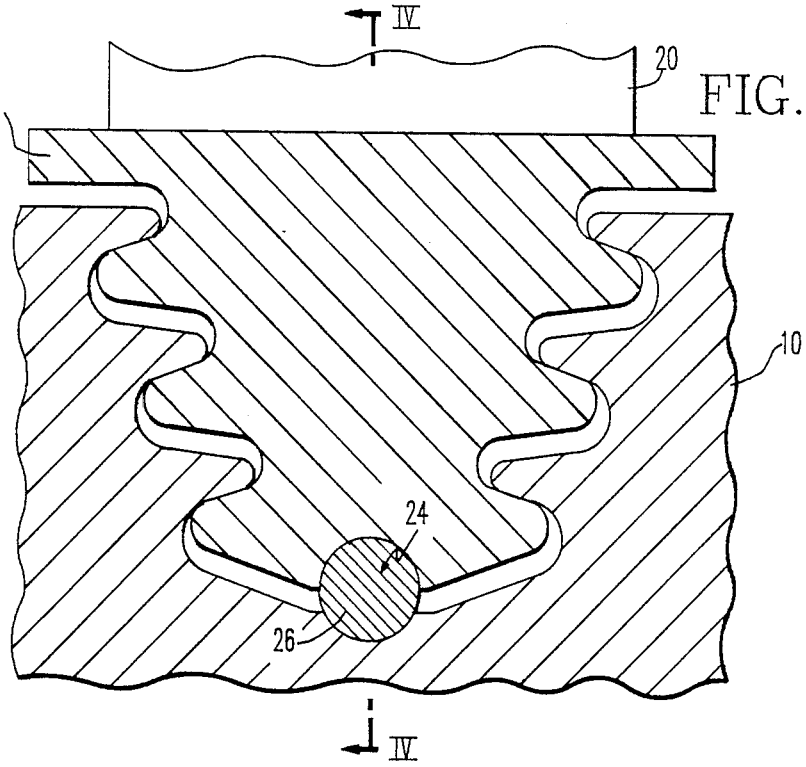
FIG. 3
FIG. 4
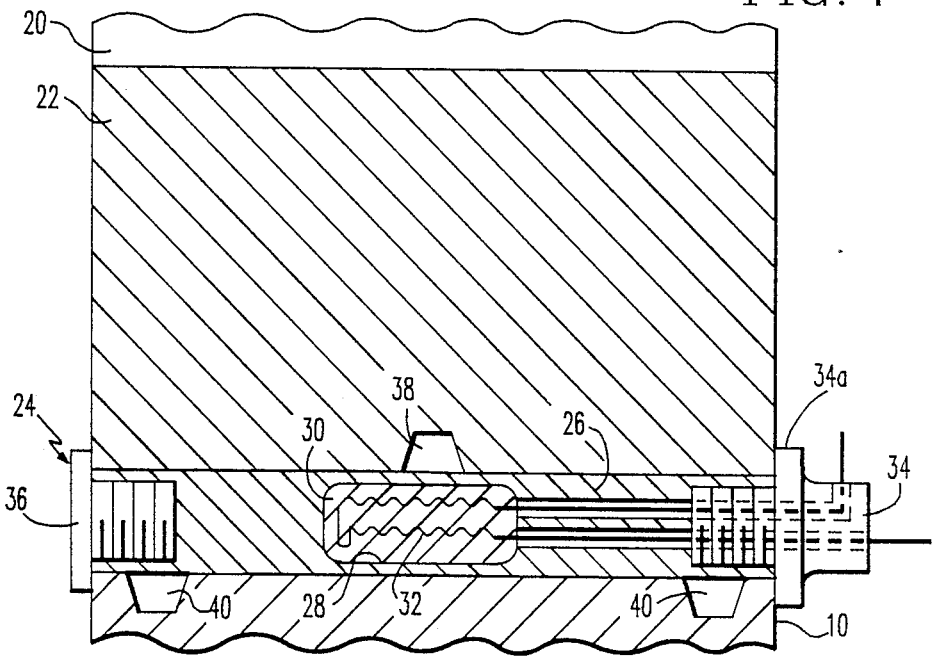

PRE-LOAD DEVICE FOR A TURBOMACHINE ROTOR

BACKGROUND OF THE INVENTION

1. Cross Reference to Related Application:

The present application is a continuation-in-part of my copending application Ser. No. 157,684 filed Feb. 19, 1988 entitled "Pre-Load Device for a Turbomachine Rotor", now abandoned.

2. Field of the Invention:

The present invention relates to a device for applying a pre-load to a turbine blade root, more particularly such a device suited for use with an axial flow turbine rotor.

3. Description of the Art:

It is well known in the art to attach a plurality of turbine blades to a turbine rotor disk by forming a plurality of generally axially extending grooves in the rotor disk and forming correspondingly shaped root portions on each of the turbine blades. The root portions are then axially slid into the mounting grooves on the rotor disk and means are provided to prevent axial movement. Typically, the rotor disk grooves and the blade root portions are formed in a "fir tree" or dovetail shape such that adjacent bearing surfaces formed on the groove and the root prevent radial movement between the elements. In another embodiment of attaching the turbine blades to a turbine rotor disk, a reverse attachment is used. In this reverse embodiment, a generally axially extending groove is formed in the root portion of each of the turbine blades, while a projection or protrusion is formed on the periphery of the rotor disk. The root portions of the blades are then axially slid over the projection on the disk and means provided to prevent axial movement. The projection and the blade root grooves are also formed in a "fir tree" or dovetail shape such that adjacent bearing surfaces formed on the projection and the root groove prevent radial movement between the elements.

However, as a practical matter, the manufacturing tolerances of the elements invariably leave a certain amount of radial clearance between the bearing surfaces. These clearances allow slight radial movement of the turbine blades. When the turbine rotor disk has achieved its stable operating speed, centrifugal force will force the respective bearing surfaces into contact with each other. During transient motion of the rotor disk, such as during start up and shut down of the turbine, the clearances between the blade root and the rotor disk allows the blades to vibrate, a characteristic which is highly undesirable and should be eliminated so as to maximize the useful life of the blades and rotor disks.

Devices have been proposed to apply a pre-load force between the turbine blade roots and the rotor disk grooves so as to take up the assembly clearances and bring the bearing surfaces into contact during those periods in which the rotor disk undergoes transient motion or is completely stationary. Typically, such devices have comprised elastic pins inserted between the bottom of the blade root and the rotor disk groove. Once installed, expansion of the devices applies a generally radially outward force to the bottom of the turbine blade roots so as to bring its bearing surfaces into contact with those corresponding bearing surfaces formed on the rotor disk groove.

Although such devices have proven generally successful, they require special tools to insert the pin. Also, special tools must be provided to remove the pins from the structure such that the individual turbine blades may be replaced. It is often necessary to drill or machine the pins to remove them from the rotor disk assembly.

It is also known to provide cam devices between the turbine blade root and the rotor disk groove to supply the pre-load force. These cam devices, which may be associated with a torsion spring, increase the complexity of the rotor disk assembly thereby rendering it more costly to produce and maintain.

It is also known to axially retain the blade root in the rotor disk groove by a pin having a fixed headed portion on one end and a deformable or removable headed portion on the opposite end. The headed portions bear against axially facing surfaces of the rotor disk and the blade root so as to prevent relative axial movement therebetween.

SUMMARY OF THE INVENTION

The present invention relates to a pre-load device which obviates the deficiencies of the known devices. The device according to the invention requires no special tools to use, is easily installed and removed, and does not increase the complexity of the rotor disk assembly.

The device according to the invention comprises a shank formed of a superplastic material which is axially insertable in a shank bore formed by confronting first and second notches formed in a turbine rotor disk and a turbine blade root respectively, the blade root mounted on the disk.

In one embodiment, the first notch is formed in the base of a mounting groove formed in the turbine rotor disk with the confronting second notch formed in the innermost portion of the blade root, and the shank bore formed thereby extends generally parallel to the axis of rotation of the rotor disk.

In another embodiment, the first notch is formed in a groove in the upper surface of a projection on he turbine rotor disk with the confronting second notch formed in a mounting groove in the blade root, and the shank bore formed thereby extends generally transverse to the axis of rotation of the rotor disk.

The shank defines an interior chamber in which is located a low-melting point material. An electrical resistance heating element is located in the low-melting point material and has means to be connected to an external electrical source. The device also includes headed portions attached to each end of the shank, each of the headed portions bearing against axially facing surfaces of the rotor disk and the blade root so that, when the head means are attached, relative axial movement between the elements is prevented.

The shank is sized so as to be readily slidable into the bore formed by the first and second notches. When it is desired to apply the pre-load to the blade roots, electrical energy is applied to the resistance heating element thereby causing its temperature, and the temperature of the low-melting point material to rise. The low-melting point material expands which, in turn, causes the expansion of the superplastic material of the shank. Radial expansion of the generally cylindrically shaped shank exerts a radial outward force on the blade root portions, thereby bringing the blade root bearing surfaces into contact with corresponding bearing surfaces on the rotor disk and taking-up the clearances between them.

BRIEF DESCRIPTION OF THE DRAWINGS

The invention will become more readily apparent from the following description of preferred embodiments thereof shown, by way of example only, in the accompanying drawings, wherein:

FIG. 3 is a partial, sectional view showing the pre-load device according to the invention installed between a rotor disk and a turbine blade root of the embodiment of FIG. 1;

FIG. 4 is a partial, longitudinal sectional view taken along lines IV—IV in FIG. 3;

DESCRIPTION OF THE PREFERRED EMBODIMENT

Figure 1:
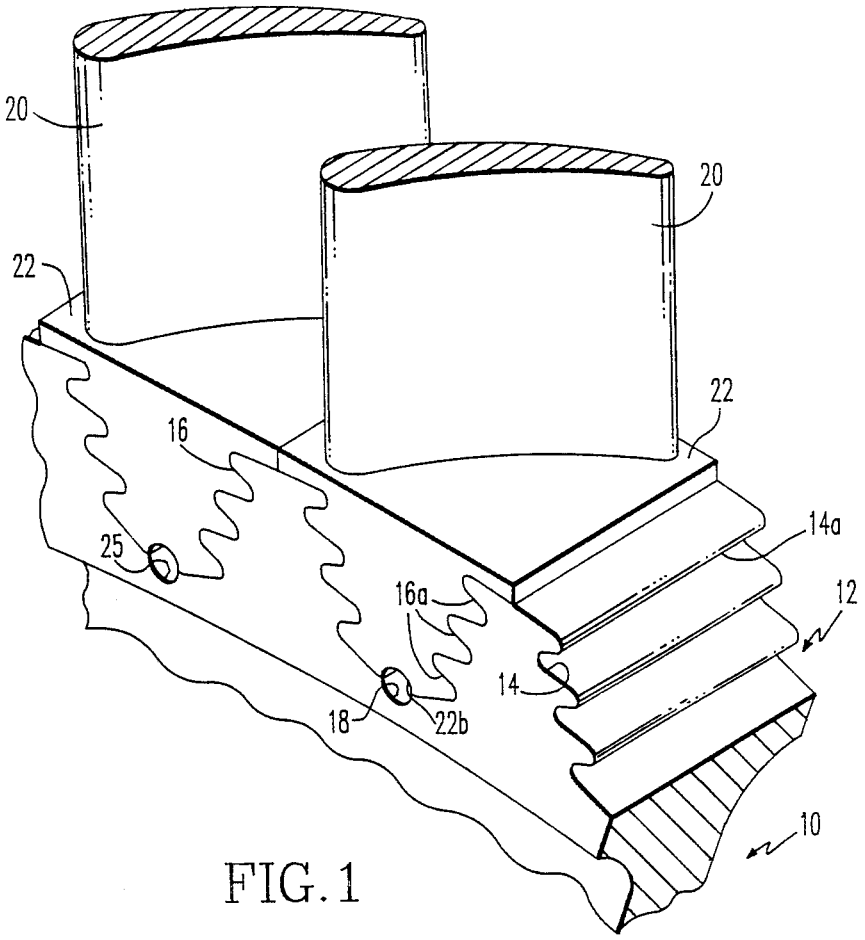
FIG. 1 is a partial, perspective view showing one embodiment of a turbomachine rotor incorporating the pre-load device according to the invention.
Figure 2:
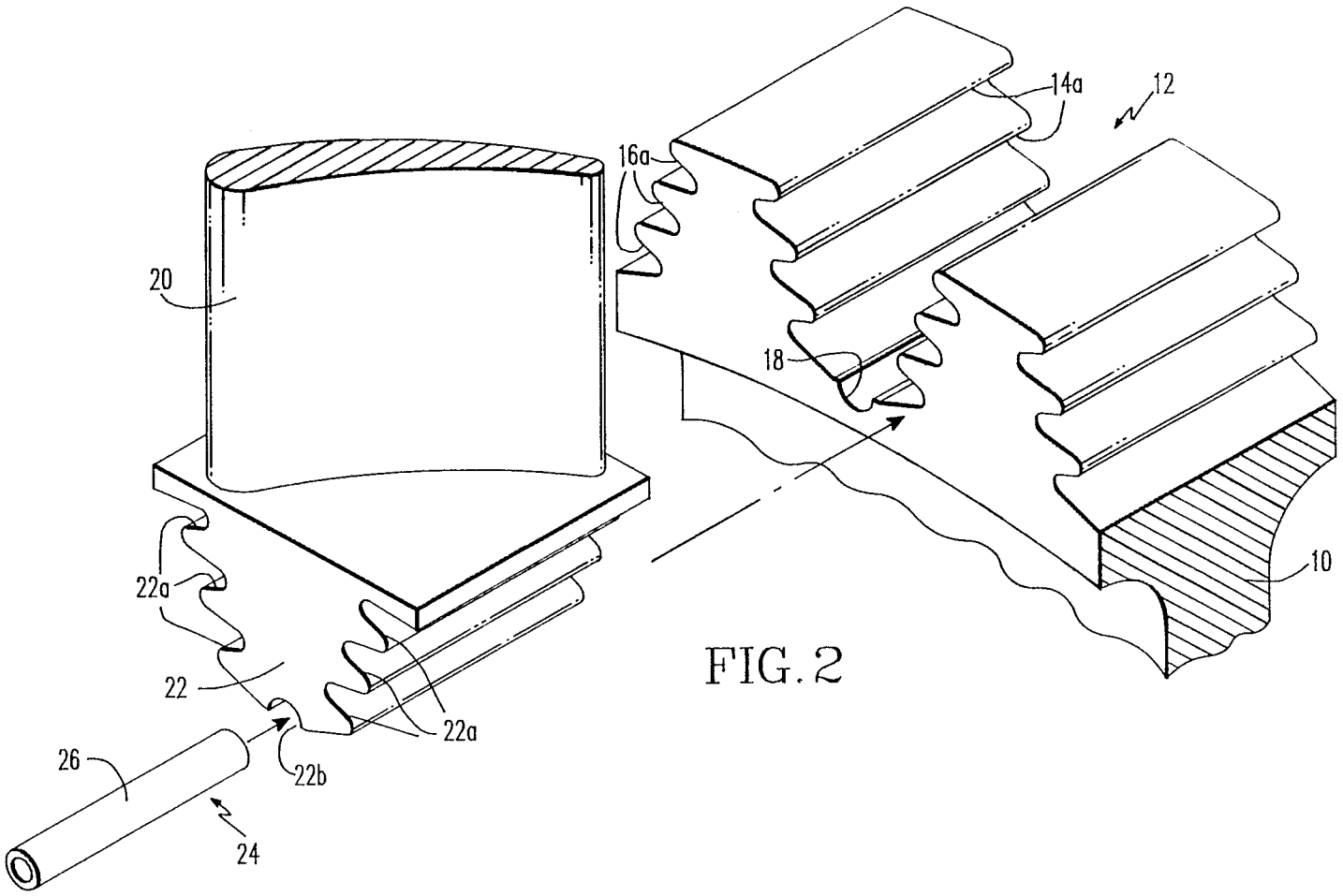
FIG. 2 is a partial, perspective exploded view showing the assembly of the pre-load device, in the embodiment of FIG. 1, according to the invention.

A portion of a one embodiment of a turbine rotor disk 10 is shown in FIGS. 1 and 2 having a plurality of substantially axially extending grooves 12 formed in is periphery. Each of the grooves 12 extends in an axial direction generally parallel to a longitudinal rotational axis (not shown) of the rotor disk 10. In known fashion, each of the grooves 12 is defined by sides 14 and 16, each having a plurality of bearing surfaces **14*a* and 16*a* formed thereon. A base portion of each groove 12 also defines a first notch 18 which extends generally parallel to the longitudinal axis of the rotor disk 10**.

A plurality of turbine blades 20, each having a root portion 22, are attached to the rotor disk 10 by axially sliding a root portion 22 into each of the grooves 12. The root portions 22 are each formed with second bearing surfaces **22*a* which, during stable operating conditions of the rotor disk, will bear against corresponding bearing surfaces 14*a* and 16*a*, respectively. In order to accommodate the sliding movement of the base portion 22 with respect to groove 12, and further due to normal tolerances encountered in the manufacturing of the rotor disk 10 and root portions 22, a certain amount of clearance will exist between bearing surfaces 22*a* and bearing surfaces 14*a* and 16*a*. In order to prevent blade vibration during transient operating conditions of the rotor disk assembly, a pre-load device 24 is inserted into a shank bore 25 formed by the first notch 18 and a confronting second notch 22*b* defined in the lowermost portion in each of the blade roots 22. As illustrated in FIG. 2, the shank 26 of the pre-load device 24 is sized so as to be readily slidable between confronting notches 18 and 22*b***.

As best seen in FIG. 4, shank 26 defines an internal chamber 28 which is filled with a low-melting point material 30. The term "low-melting point" as used herein indicates a solid material having a melting point in the range of about 94° to 538° C. (200° to 1000° F.), and which is below the melting point of the superplastic material of the shank 26. Examples of such a low-melting material are a tin-lead solder or eutectic, a silver-copper eutectic or other alloys such as yttrium, bismuth or beryllium alloys and related eutectics having the desired melting point. An expandable means 31 is provided, which can comprise resistance heating element 32, or other heating means, and extends into the low-melting point material 30 and is electrically connected to threaded heater boss 34. Heater boss 34 is threadingly engaged with one end of the shank 26 and defines a headed portion **34*a* which bears against axially facing surfaces of the blade root 22 and the rotor disk 10**.

A second head 36 is threadingly engaged with the opposite end of shank 26 and also defines a headed portion which bears against axially facing surfaces of the blade root 22 and the rotor disk 10. As can be seen, once the heater boss 34 and head 36 are engaged with either end of the shank 26, relative axial movement between the blade root 22 and the rotor disk 10 will be prevented.

The shank 26 is formed from a superplastic material, which may be a hypereutechtoid nickel-chrome alloy capable of plastically deforming at least 500%. Examples of other superplastic materials which may be used include, but are not limited to alloys such as:

(1) Nickel-chrome Kh 20 N80

(2) Nickel Modified Titanium 6 Aluminum 4 Vanadium (3) Zinc-Aluminum (4) Nickel 75% Boron 17% Silicon 8%

(5) Aluminum-Copper Eutectic (6) Zh S 6U - Heat Resistant Alloy

When it is desired to apply a pre-load to the blade root 22, resistance heating element 32 is connected to an electrical source which, accordingly to known principles, causes the temperature of the resistance heating element 32 to rise. The increase in temperature of the heating element 32 causes the low-melting point material 30 to expand thereby causing similar expansion of the shank 26. Most of the expansion will take place in the radial direction which serves to take up the clearances between the bearing surfaces **22*a*, and the bearing surfaces 14*a* and 16*a* so as to bring them into mutual contact as shown in FIG. 3. The pre-load will prevent any blade vibration or movement between the blade and the rotor disk during transient operating conditions of the rotor disk assembly. Locking notches 38 and 40 may be formed in the blade root 22 and the rotor disk 10**, respectively.

Figure 5:
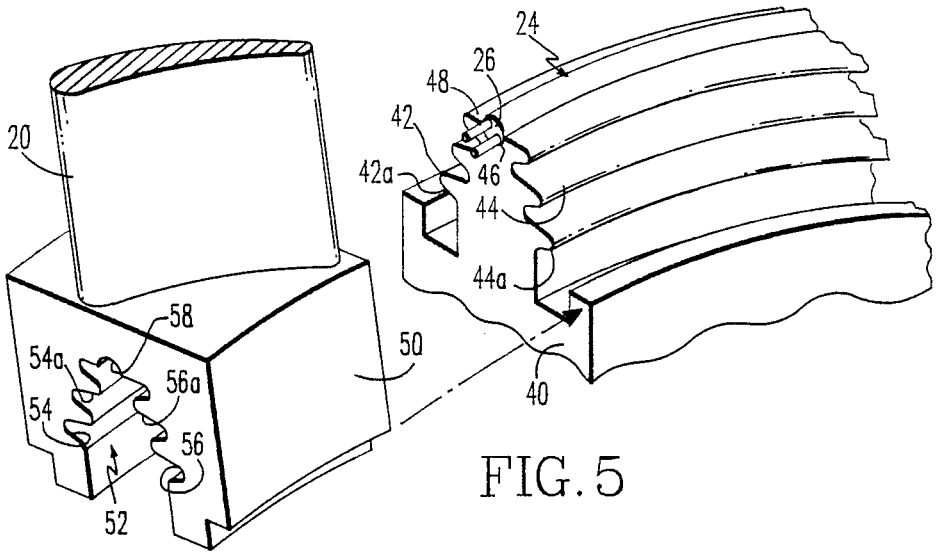
FIG. 5 is a partial, perspective exploded view showing another embodiment of a turbomachine rotor incorporating the pre-load device according to the invention.
Figure 6:
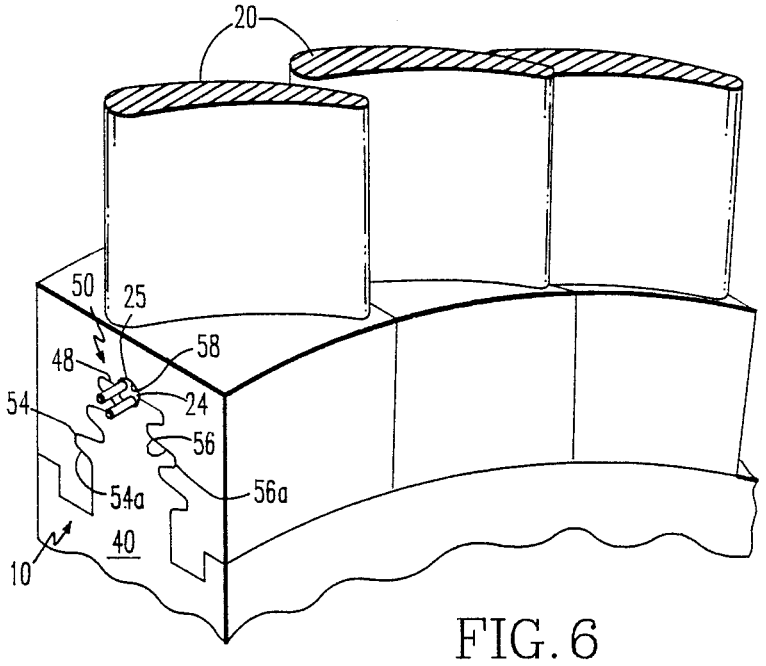
FIG. 6 is a partial, sectional view showing the pre-load device according to the invention installed between a rotor disk projection and a turbine blade root of the embodiment of FIG. 5.

A portion of another embodiment of a turbine rotor disk 10 is shown in FIGS. 5 and 6 having an axially extending projection 40 formed on its periphery. The projection 40 extends in a direction generally transverse to the longitudinal rotational axis (not shown) of the rotor disk 10. The projection 40 is formed with sides 42 and 44, each having a plurality of bearing surfaces **42*a* and 44*a* formed therein. A first notch 46 is formed in the upper surface 48 of the projection 40 which extends generally transverse to the longitudinal axis of the rotor disk 10**.

A plurality of turbine blades 20 are provided, each having a root portion 50, the root portion 50 having a mounting groove 52 therein which extends generally transverse to the longitudinal axis of the rotor disk 10. Each of the mounting grooves 52 is defined by sides 54 and 56, each having a bearing surface **54*a* and 56*a* formed thereon. A base portion of each groove 52 has a confronting second notch 58 formed in the blade root. The pre-load device 24 is inserted into a shank bore 25 formed by the first notch 46 in projection 40 and the confronting second notch 58 in the blade root mounting groove 52, and is sized so as to be slidable between confronting notches 46 and 58. In this embodiment, with the closing of the last blade, as it is commonly called, on the rotor disk projection, it does not have the stress reducing or expansion tube. The opening for the last or closing blade will contain the electrical connections for the heating element 32 for the low melting point material 30 and a means to maintain the proper orifice and alignment for the last blade fit up. After the shank 26** of superplastic material is expanded, the closing blade will be assembled in place.

The foregoing description is provided for illustrative purposes only and should not be construed as in any way limiting this invention, the scope of which is defined solely by the appended claims.

I claim as my invention:

1. A device for exerting a pre-load force between a turbine rotor disk and a turbine blade root mounted therewith comprising:

(a) a shank formed of a superplastic material insertable in a shank bore defined between the blade root and the rotor disk; and, (b) expandable means located within the shank to cause the superplastic material to expand, thereby exerting a pre-load force on the blade root.

2. The device of claim 1 wherein said shank bore is formed by a first notch formed in a mounting groove in the turbine rotor disk and a confronting second notch formed in the innermost portion of the blade root.

3. The device of claim 1 wherein the superplastic material has a plastic deformation of at least 500%.

4. The device of claim 1 wherein the shank is formed of a hypereutectoid nickel chrome alloy.

5. The device of claim 1 wherein the expandable means comprises:

(a) a chamber defined by the shank;

(b) a material having a low-melting point located in the chamber; and (c) heating means to heat the low-melting point material causing it to expand so as to expand the shank and exert the pre-load force on the blade root.

6. The device of claim 5 wherein the heating means comprises:

(a) an electrical resistance heating element located in the low-melting point material; and (b) means to connect the heating element to an electrical source.

7. The device of claim 6 wherein the superplastic material has a plastic deformation of at least 500%.

8. The device of claim 7 wherein the shank is formed of a hypereutectoid nickel chrome alloy.

9. The device of claim 1 wherein said shank bore is formed by a first notch formed in the upper surface of a projection on the turbine rotor disk and a confronting second notch formed in a mounting groove in the blade root.

10. A turbomachine rotor disk assembly comprising:

(a) a rotor disk having a central rotational axis;

(b) a plurality of turbine blades each blade having a root portion slidably mounted on said rotor disk;

(c) confronting first and second notches in each of said rotor disk and root portion of said turbine blades, respectively, forming a shank bore therebetween; and (d) at least one device, disposed in said shank bore, for exerting a pre-load force between each of the blade root portions and the rotor disk, said device comprising:

(i) a shank inserted in the shank bore, the shank formed of a hypereutectoid alloy having a plastic deformation of at least 500% and defining an internal chamber;

(ii) a low-melting point material located in the internal chamber;

(iii) an electrical resistance heating element located in the low-melting point material;

(iv) means to connect the resistance heating element to an electrical source such that application of electricity to the heating element raises the temperature of the heating element and, consequently, the low-melting point material causing it to expand thereby expanding the shank so as to exert a pre-load force on the associated blade root portion; and (v) head means attached to each end of the shank and bearing on opposite axially facing surfaces of the blade root portion and the rotor disk so as to prevent relative axial movement therebetween.

11. The turbomachine rotor disk assembly of claim 10 wherein said rotor disk has a plurality of mounting grooves extending generally parallel to the rotational axis thereof, each groove having a bottom defining said first notch, and each said root portion of said turbine blade defines a said second confronting notch in substantial axial adjustment with said first notch to form said shank

12. The turbomachine rotor disk assembly of claim 10 wherein said rotor disk has a projection thereon, extending generally transverse to the rotational axis thereof, with said first notch formed in the upper surface of said projection, and each said blade root portion has a mounting groove therein, said mounting groove having a said second confronting notch formed thereon in substantial axial alignment with said first notch to form said shank bore.

13. A turbomachine rotor disk assembly comprising:

(a) a rotor disk having a central rotational axis and defining a plurality of mounting grooves extending generally parallel to the rotational axis, each groove having a bottom defining a first notch;

(b) a plurality of turbine blades, each blade having a root portion slidably mounted in a mounting groove, each root portion defining a second notch in substantial axial adjustment with the first notch to form a shank bore; and (c) a plurality of devices for exerting a pre-load force between each of the blade root portions and the rotor disk, each device comprising:

(i) a shank inserted in the shank bore, the shank formed of a hypereutectoid nickel chrome alloy having a plastic deformation of at least 500% and defining an internal chamber;

(ii) a low-melting point material located in the internal chamber;

(iii) an electrical resistance heating element located in the low-melting point material;

(iv) means to connect the resistance heating element to an electrical source such that application of electricity to the heating element raises the temperature of the heating element and, consequently, the low-melting point material causing it to expand thereby expanding the shank so as to exert a pre-load force on the associated blade root portion; and (v) head means attached to each end of the shank and bearing on opposite axially facing surfaces of the blade root portion and the rotor disk so as to prevent relative axial movement therebetween.

14. A turbomachine rotor disk assembly comprising:

(a) a rotor disk having a central rotational axis and a projection thereon extending generally transverse to the rotational axis, and a first notch formed in the upper surface of said projection;

(b) a plurality of turbine blades, each blade having a root portion with a mounting groove therein, and a confronting second notch in the base of said mounting groove to form a shank bore; and (c) at least one device for exerting a pre-load force between the blade root portions and the rotor disk, said device comprising:

(i) a shank inserted in the shank bore, the shank formed of a hypereutectoid nickel chrome alloy having a plastic deformation of at least 500% and defining an internal chamber;

(ii) a low-melting point material located in the internal chamber; and (iii) an electrical resistance heating element located in the low-melting point material;

(iv) means to connect the resistance heating element to an electrical source such that application of electricity to the heating element raises the temperature of the heating element and, consequently, the low-melting point material causing it to expand thereby expanding the shank so as to exert a pre-load force on the associated blade root portion.

* * * * *